United States Patent [19]

Cox et al.

[11] Patent Number: 5,028,284

[45] Date of Patent: Jul. 2, 1991

[54] EXPLOSION EFFECTS ENHANCER FOR FIREWORKS

[75] Inventors: Bert D. Cox, St. Joseph; Edmond T. Stamps, Garden City, both of Mo.

[73] Assignee: Chemfx, Ltd., Rushville, Mo.

[21] Appl. No.: 513,892

[22] Filed: Apr. 24, 1990

[51] Int. Cl.[5] ..... C06G 45/02

[52] U.S. Cl. ..... 149/21; 149/2; 149/109.4; 149/109.6; 149/110; 149/115; 149/60

[58] Field of Search ..... 149/21, 109.4, 60, 2, 149/109.6, 110, 115

[56] References Cited

U.S. PATENT DOCUMENTS 4,404,050 9/1983 Yorke et al. ..... 149/2
4,420,349 12/1983 Bampfield, I ..... 149/2
4,435,232 3/1989 Ciaramitaro et al. ..... 149/2
4,470,855 9/1984 Bampfield, II ..... 149/2

*Primary Examiner*—Lechert, Jr., Stephen J.
*Attorney, Agent, or Firm*—Kokjer, Kircher, Bradley, Wharton, Bowman & Johnson

[57] ABSTRACT

A method and composition for enhancing the visual effect of a combustion explosion without substantially increasing the explosive force is the subject matter of this invention. A solid explosive compound is combined with a ground combustible particulate material that is characterized by a wide distribution of particle sizes. Preferably the surface area of the particles will vary by a factor of at least 500 percent and no more than 10 percent of the total number of particles will be represented by any one particle size.

12 Claims, No Drawings

EXPLOSION EFFECTS ENHANCER FOR FIREWORKS

This invention relates generally to compositions utilized in staged explosions and, more particularly, to a method and composition for enhancing the visual effect of a combustion explosion without substantial enhancement of the explosive force.

Staged explosions are explosions which are purposefully set for effects in motion picture filming, military exercises, fire and police training, scientific testing and analyses, and firework displays. The most frequent usage is for the motion picture industry. By "staged explosions" is meant any explosion that is intentionally set with the objective of avoiding or at least minimizing the destructive force of the explosion. It has long been known that the visual effect of a combustion explosion can be significantly increased by the utilization of an explosion enhancer. Various enhancer compositions have been previously employed, most commonly gasoline, naptha, napthalene, or other highly flammable solvents which will increase the fireball from the explosion without significantly increasing the explosive force Fuller's Earth is a known non-flammable explosive enhancer. Compositions such as powdered aluminum and powdered magnesium are also known as explosion enhancers but have the drawback that they increase the explosive force. Because these previously known enhancers are highly flammable or explosive themselves, a serious safety problem is presented when they are used. This in turn substantially increases the cost of staging the special effect because of necessary safety precautions which must be taken.

The present invention provides a method and composition for enhancing the visual effect of a combustion explosion without substantial enhancement of the explosive force utilizing a material which is in no way explosive in and of itself and is not highly flammable as are heretofore used organic solvents.

It is therefore a primary object of the present invention to provide a method and composition for enhancing the visual effect of a staged combustion explosion which does not substantially increase the explosive force.

As a corollary to the above object, it is an aim of this invention to provide a method and composition for enhancing the visual effect of a staged combustion explosion which is much safer than highly flammable solvents and other materials which have heretofore been used as explosion enhancers.

Another corollary to the object first set forth above, is to provide a method and composition utilizing a material which is not in and of itself explosive and can therefore be safely stored in large quantities without the need to take special precautions.

Still another important objective of this invention is to provide a method and composition for enhancing the visual effect of a staged combustion explosion wherein little or no burning residue reaches the ground after the explosion occurs.

It is also an important objective of our invention to provide a method and composition for enhancing the visual effect of a staged combustion explosion wherein the explosion enhancer utilizes naturally occurring waste materials and is therefore very economical.

One of the important aims of this invention is to provide a method and composition meeting the aims and objectives heretofore set forth which does not present any potential for environmental contamination during either manufacture or usage.

An important object of the invention is to provide a method and composition for enhancing the visual effect of a staged combustion explosion wherein the explosion enhancer can be used either dry or slightly wetted to vary the visual effect presented.

Still another objective of this invention is to provide a method and composition for enhancing the visual effect of a staged combustion explosion wherein the explosion danger does not increase regardless of the quantity of enhancer which is present relative to a given explosive material.

One further specific objective of the method and composition of the present invention is to present an explosion enhancer which is adaptable for use with virtually any solid explosive (low or high order) including primer cord, black powder, TNT, dynamite, and PETN.

Other objects and aims of the invention will be made clear or become apparent from the following description and claims.

In its broadest aspect, the present invention encompasses a composition for enhancing the visual effect of a combustion explosion which comprises any ground combustible particulate material characterized by a wide distribution of particle sizes. It is important that the material utilized in the composition be ground or otherwise comminuted to present a wide distribution of particle sizes, shapes and configurations.

Preferably, the material utilized will vary in particle size from as fine as material having the physical characteristics of face powder, up to particles which are two or three millimeters in at least one dimension. The particulate material should present particles of differing sizes so that the surface area of the individual particles varies by a factor of at least 500 percent. The particles are preferably of random and irregular shapes. The size distribution of the particles comprising the material to be utilized should vary sufficiently so that no more than about 10 percent of the total number of particles is represented by any one particular size.

As indicated previously, virtually any combustible material which can be ground into particles can be utilized in the composition of the invention, although dried ground plant material is most often utilized. Dried ground vegetable hulls such as cottonseed hulls and those presented by the cereal grains represent a preferred material. In particular, ground oat hulls, rice hulls, and soybean hulls work well.

Virtually any solid explosive compound can be combined with the explosion enhancer according to the present invention to present an explosive composition. In particular, low order explosives such as black powder (a combination of potassium nitrate, charcoal and sulfur in a weight ratio of 75:15:10), are preferred. Another suitable explosive is primer cord which contains pentaerythritol tetranitrate (PETN). Trimethylene trinitramine (RDX) may also be employed. More powerful high order explosives such as dynamite, nitroglycerin and ammonium nitrate are generally avoided because of the danger in utilizing them, although they are operable.

A staged explosion may be carried out utilizing lofting charges which are well known to those skilled in the art. The lofting charge or bomb includes a preliminary charge and aerial device which propels the primary explosive along with the enhancer to the desired elevation where it is detonated.

The explosion enhancer of the invention may be utilizing as either a "hard" or "soft" bomb. These are terms well known to those skilled in the art. A "hard" bomb is where the explosive compound is wrapped in some type of encasement which may be cardboard, a fiber material or a plastic film triple wrapped with plastic tape. A so called "soft" bomb is made by splitting the sides of the explosive encasement used for the "hard" bomb or by simply utilizing a wrap of light weight plastic material which is bound by only a single layer of tape.

The enhancer composition according to the invention may also be utilized with a primer cord. The enhancer is placed on top of the cord in the desired quantity.

The quantity of enhancer utilized relative to the quantity of explosive for any particular application can vary over a wide range but generally a minimum of one percent (by weight) of explosive relative to the quantity of enhancer should be employed. There is no practical upper limit on the quantity of explosive except those imposed by safety considerations.

The following examples are illustrative of the explosion enhancer composition according to the present invention:

Example 1

A suitable explosion enhancer composition was presented by ground oat hulls comminuted to a size ranging from fine powder to approximately 6 millimeters in length and 0.5 millimeters in width.

Example 2

A composition prepared according to Example 1 was utilized in conjunction with a black powder "soft" bomb explosive in the following manner. Thirty-three pounds of enhancer composition was placed on top of one pound of the explosive compound. Upon detonation, a fireball 12 to 15 feet in diameter and rising approximately 25 feet from the ground was observed.

Example 3

This example was identical to Example 2 except the quantity of enhancer was reduced by about 66 percent. The fireball was approximately 12 to 15 feet in diameter and rose about 10 feet from the ground.

Example 4

A composition prepared according to Example 1 was utilized in 100 pound quantities and combined with 1 pound of black powder explosive.

If an enhanced smoke cloud is a desired effect of the staged explosion, the enhancer according to the present invention can be utilized in conjunction with additives such as Fuller's Earth, talc, ball clay or other dust materials.

From the foregoing, it will be appreciated that the invention also encompasses a method of enhancing the visual effect of the explosion of a combustible compound without substantially increasing the explosive force by adding to the combustible compound a quantity of a combustible particulate material characterized by a wide distribution of particle sizes. Preferably, the combustible compound comprises at least one percent by weight the total composition. It is also preferable that the method be carried out by adding particles of said material having a size distribution such that no one size comprises more than about 10 percent of the total number of particles present.

From the foregoing, it will be seen that this invention is one well adapted to attain all the ends and objects hereinabove set forth as well as other advantages which are likely to become apparent upon utilization of the invention in commercial applications.

It will be understood that certain features and subcombinations of the invention disclosed are of utility and may be employed without reference to other features and subcombinations. This is contemplated by and is within the scope of the claims.

Since many possible embodiments may be made of the invention without departing from the scope thereof, it is understood that all matter herein set forth is to be interpreted as illustrative and not in a limiting sense.

we claim:

1. A composition utilized in conjunction with a solid explosive for enhancing the visual effect of a combustion explosion without substantially increasing the explosive force, said composition comprising:

ground combustible particulate material characterized by a wide distribution of particle sizes, wherein the surface area of said particles varies by a factor of at least 500 percent.

2. A composition as set forth in claim 1, wherein said particles are of random configurations.

3. A composition as set forth in claim 2, wherein said material comprises ground dried vegetable hulls.

4. A formulation for use in a staged explosion comprising:

a solid explosive compound; and a ground combustible particulate material characterized by a wide distribution of particle sizes, wherein the surface area of said particles varies by a factor of at least 500 percent.

5. A formulation as set forth in claim 4, wherein said solid explosive compound comprises a low order explosive.

6. A formulation as set forth in claim 5, wherein said particles are of random size and configuration.

7. A formulation as set forth in claim 6, wherein said material comprises ground dried vegetable hulls.

8. A method of enhancing the visual effect of the explosion of a solid combustible compound in a staged explosion without substantially increasing the explosive force, said method comprising:

adding to said combustible compound a quantity of a combustible particulate material characterized by a wide distribution of particle sizes, wherein the surface area of said particles varies by a factor of at least 500 percent.

9. A method as set forth in claim 8, wherein said combustible compound is present in a quantity of at least about one percent by weight.

10. A method as set forth in claim 9, wherein said adding step comprises adding particles having a size distribution such that no one particle size comprises more than about 10 percent of the total number of particles present.

11. A composition as set forth in claim 1, wherein said particles have a size distribution such that no one particle size comprise more than about 10 percent of the total number of particles present in said composition.

12. A method as set forth in claim 4 wherein said particles have a size distribution such that no one particle size comprises more than about 10 percent of the total number of particles present in said composition.

* * * * *